US010458116B2

(12) United States Patent
Krupskij et al.

(10) Patent No.: US 10,458,116 B2
(45) Date of Patent: Oct. 29, 2019

(54) BUILDING ELEMENT MADE OF A FIBROUS MATERIAL AND BUILDING CONSTRUCTION UTILIZING SAME

(71) Applicant: LLC "ECOCUBER", Moscow (RU)

(72) Inventors: Vladimir Pavlovich Krupskij, Leskovka (BY); Andrej Iosifovich Hovratovich, Minsk (BY); Aleksandr Igorevich Osika, Moscow (RU)

(73) Assignee: LLC "Ecocuber" (RU)

( * ) Notice: Subject to any disclaimer, the term of this patent is extended or adjusted under 35 U.S.C. 154(b) by 0 days.

(21) Appl. No.: 16/070,287

(22) PCT Filed: Dec. 22, 2016

(86) PCT No.: PCT/EA2016/000003

§ 371 (c)(1),
(2) Date: Jul. 15, 2018

(87) PCT Pub. No.: WO2017/121437

PCT Pub. Date: Jul. 20, 2017

(65) Prior Publication Data

US 2019/0024374 A1 Jan. 24, 2019

(30) Foreign Application Priority Data

Jan. 15, 2016 (EA) ..... 201600369

(51) Int. Cl.
*E04C 1/40* (2006.01)
*E04B 2/00* (2006.01)
(Continued)

(52) U.S. Cl.
CPC ..... *E04C 1/40* (2013.01); *E04B 1/3555* (2013.01); *E04B 1/78* (2013.01); *E04B 2/00* (2013.01);
(Continued)

(58) Field of Classification Search
CPC ..... E04C 2/46; E04C 2/16; E04C 1/40; E04B 2/56; E04B 1/78
See application file for complete search history.

(56) References Cited

U.S. PATENT DOCUMENTS 1,633,702 A * 6/1927 Monroe ..... E04B 2/26 52/289
4,170,856 A * 10/1979 Musser ..... E04C 1/40 110/340
(Continued)

FOREIGN PATENT DOCUMENTS

EA 021316 B1 12/2013
EP 2878740 A1 3/2013
(Continued)

OTHER PUBLICATIONS

ISA/RU, International Search Report and Written Opinion of the International Searching Authority in PCT/EA2016/000003, dated Jul. 20, 2017.
(Continued)

*Primary Examiner* — Paola Agudelo
(74) *Attorney, Agent, or Firm* — Oliver Edwards; Law Office of Oliver Edwards LLC

(57) ABSTRACT

The invention relates to building elements and building constructions, and more particularly to building systems which utilize compressed blocks made of a fibrous material in conjunction with a framework in order to form building constructions for buildings and structures. The present building element consists of a block 2 made of a fibrous material, and forming elements which are disposed on the surfaces of the block and consist of a pair of frames 3 interconnected by at least one transverse brace 4 to form a single structure. The building element also comprises a forming mesh 5, which is disposed between the fibrous material block 2 and the frames 3, on top of the transverse braces 4 that connect the frames 3; outer and inner walls 6, which are fastened from the outer sides of the frames 3; and membranes 7, which are disposed between the walls 6 and
(Continued)

Figure 1:
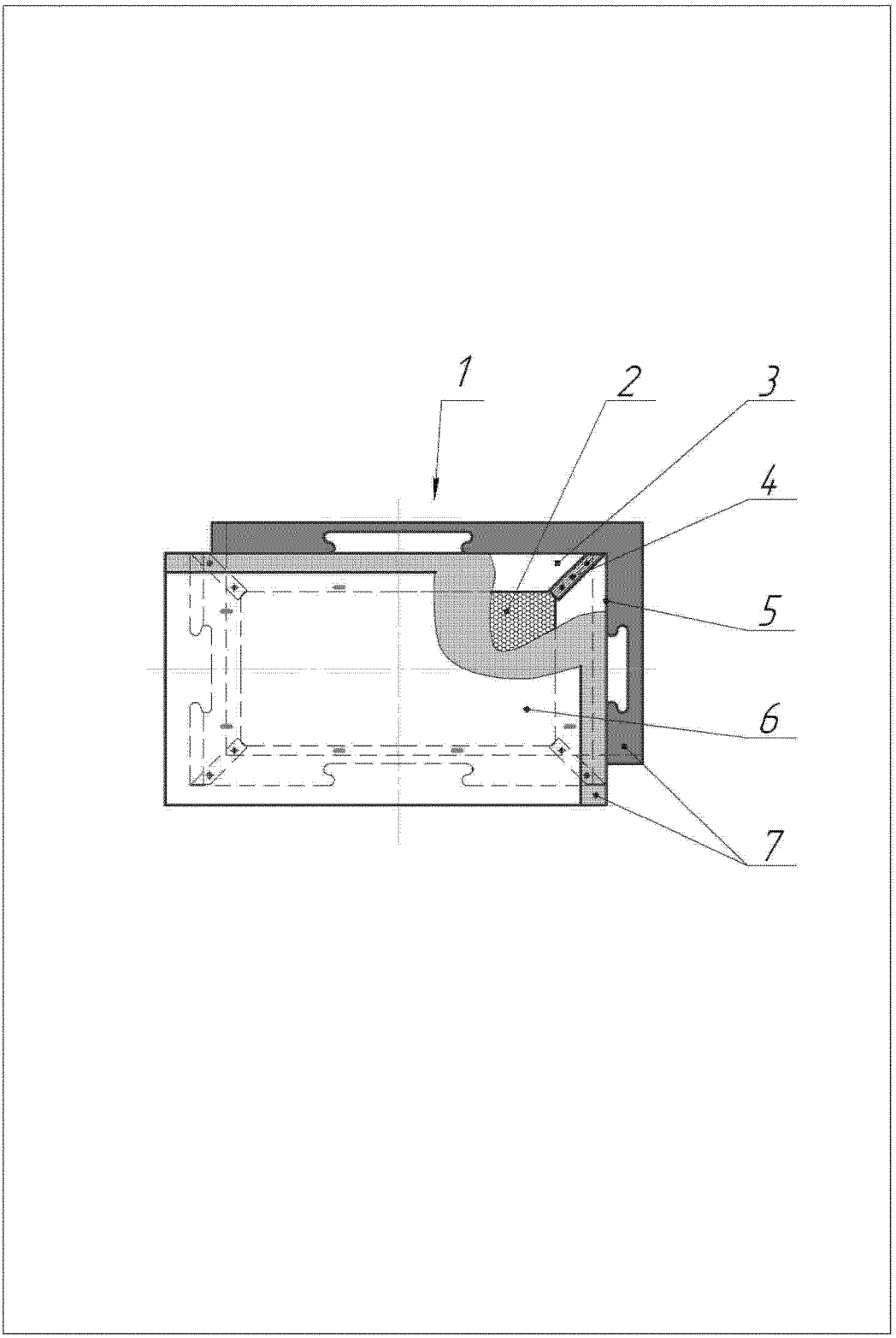

the frames 3. The outer contour of the frames 3 comprises curvilinear jigsaw-like locking elements. On the ends of the vertical sides of the frames 3 there are provided slots 9 for load-bearing fastening strips 10; and the membranes 7 extend beyond the edge of the outer and inner walls 6. The invention also relates to a building construction consisting of the claimed building elements, wherein the building elements are joined to one another by the outer edges of the frames 3 by means of the curvilinear jigsaw-like locking elements and load-bearing fastening strips 10, and the building elements are arranged in a row and one above the other to form a single spatial construction.

10 Claims, 5 Drawing Sheets

(51) Int. Cl.

| | |
|---|---|
| ***E04C 2/16*** | (2006.01) |
| ***E04B 1/35*** | (2006.01) |
| ***E04B 1/78*** | (2006.01) |
| *E04B 2/56* | (2006.01) |
| *E04C 2/38* | (2006.01) |

(52) U.S. Cl.
CPC ..... *E04C 2/16* (2013.01); *E04C 2/46* (2013.01); *E04B 2/56* (2013.01); *E04C 2/384* (2013.01)

(56) References Cited

U.S. PATENT DOCUMENTS

| | | | | |
|---|---|---|---|---|
| 4,516,375 | A * | 5/1985 | Pagano | E04C 1/40 52/581 |
| 5,749,199 | A | 5/1998 | Allen | |
| 7,073,306 | B1 | 7/2006 | Hagaman | |
| 8,448,410 | B2 * | 5/2013 | Korman | B29C 43/06 52/750 |
| 9,580,906 | B1 * | 2/2017 | Spencer | E04C 2/46 |
| 2003/0208982 | A1 * | 11/2003 | Korman | E04B 1/3555 52/596 |
| 2004/0177580 | A1 * | 9/2004 | Tremelling | E04B 2/8617 52/426 |
| 2008/0245005 | A1 * | 10/2008 | Fennell | E04C 1/40 52/223.7 |
| 2013/0333319 | A1 | 12/2013 | Zinser | |
| 2014/0223848 | A1 * | 8/2014 | Binhussain | E04B 2/18 52/309.17 |
| 2015/0107176 | A1 * | 4/2015 | Cetindag | F41J 13/00 52/309.16 |
| 2015/0308113 | A1 * | 10/2015 | Blum | E04C 1/40 52/404.4 |
| 2016/0010329 | A1 * | 1/2016 | Marstein | E04B 2/46 52/293.3 |
| 2016/0281357 | A1 * | 9/2016 | Aribas | E04B 2/14 |

FOREIGN PATENT DOCUMENTS

| | | | |
|---|---|---|---|
| RU | 98441 | U1 | 10/2010 |
| RU | 147886 | U1 | 11/2014 |
| WO | 0225025 | A | 3/2002 |

OTHER PUBLICATIONS

EPO, European search opinion and Supplementary European search report in EP3404160, dated Jan. 18, 2019.

* cited by examiner

BUILDING ELEMENT MADE OF A FIBROUS MATERIAL AND BUILDING CONSTRUCTION UTILIZING SAME

The invention relates to building elements and building constructions, and more particularly to building systems which utilize compressed blocks made of a fibrous material in conjunction with a framework in order to form building constructions for buildings and structures.

There are constructed building panels [1] which consist of a wooden frame, multiple compressed blocks made of a fibrous material packed in the frame. These panels are contracted and stabilized after being constructed. The constructed building panels have the ability to be joined together and be erected as a wall.

The major drawback of these building panels are their large size and weight. This can cause additional transportation costs in the form of loading and unloading operations. The extra cost is due to more required laborers and a hoisting machine.

Such format of these building panels cause substantial constraints on the architecture and building construction.

There exists a building element and a building construction [2] in which the building element consists of a straw bale and a pair of forming elements disposed on the opposite ends of the straw bale, and the forming elements can connect the neighboring straw bales. The building elements in the building construction are laid on top of each other in rows fashioned after bricklaying, with the forming elements creating a truss. The building farm also comprises a row of vertical tightening rods/

The drawbacks of this solution are limitation of the number of floors in a building, the shape and size of a roof, limitation in the construction of the rafter frame configuration and the load pattern of load transfer to the walls.

The prototype of the suggested technical solution is a building element made of a fibrous material and a building construction [3]. The building element in this construction consists of a block of a fibrous material and a pair of forming elements, disposed on the opposite surfaces of the given block. They are the frames with the outer perimeter equal to the outer surface of the given block. The frames of a building element are interconnected by, at least, one transverse brace, making a framework and are tightened to a block made of a fibrous material in a single construction by fastening.

The drawback of this technical solution is insufficient durability, economy and heat resistance of the created buildings, and a certain difficulty during assembling.

The aim of the proposed invention is the creation of a universal building element that meets the higher ecological, economical and energy-effective requirements of the building in comparison with the prototype, and is durable from the constructive standpoint and at the same time has higher heat resistance, that is not prone to shrinkage, easy to assemble and produce and not resource-consuming.

To solve the set tasks a different building element is proposed. The present building element consists of a block 2 made of a fibrous material, and forming elements which are disposed on the surfaces of the block and consist of a pair of frames 3 interconnected by at least one transverse brace 4 to form a single structure. The building element also comprises a forming mesh 5, which is disposed between the fibrous material block 2 and the frames 3, on top of the transverse braces 4 that connect the frames 3; outer and inner walls 6, which are fastened from the outer sides of the frames 3; and membranes 7, which are disposed between the walls 6 and the frames 3. The outer contour of the frames 3 comprises curvilinear jigsaw-like locking elements.

In the preferred version of the invention on the ends of the vertical sides of the frames 3 there are provided slots 9 for load-bearing fastening strips 10.

Preferably, the membranes 7 extend beyond the edge of the outer and inner walls 6.

Block 2 preferably is made of a fibrous material, processed by a disinfecting solution or electromagnetic radiation.

In one of the versions of the invention the frames 3 are interconnected by, at least, one transverse brace 4 by fastening.

In another version the frames 3 are interconnected by, at least, one transverse brace 4 by interlock.

In yet another version the frames 3 are interconnected by, at least, one transverse brace 4, produced as a single construction by punching, molding or 3D-printing.

In one of the versions the walls 6 have distance spaces on the side of the membranes 7.

In another version the walls 6 have double-layer walls with the distance spacers between the layers.

The invention also relates to a building construction consisting of the claimed building elements, wherein the building elements are joined to one another by the outer edges of the frames 3 by means of the curvilinear jigsaw-like locking elements and load-bearing fastening strips 10, and the building elements are arranged in a row and one above the other to form a single spatial construction.

The preferred version of the proposed technical solution in details is presented on the drawings.

FIG. 1—the front view of the building element.

Figure 2:
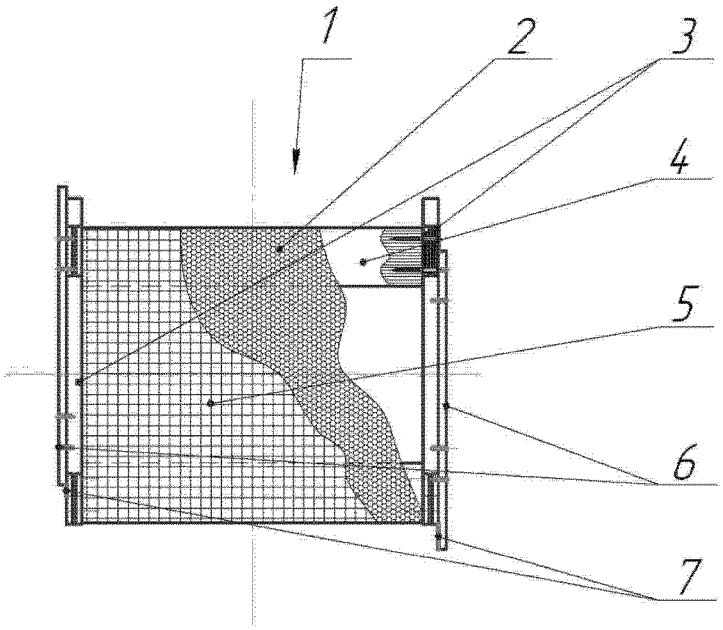

FIG. 2—the side view of the building element.

Figure 3:
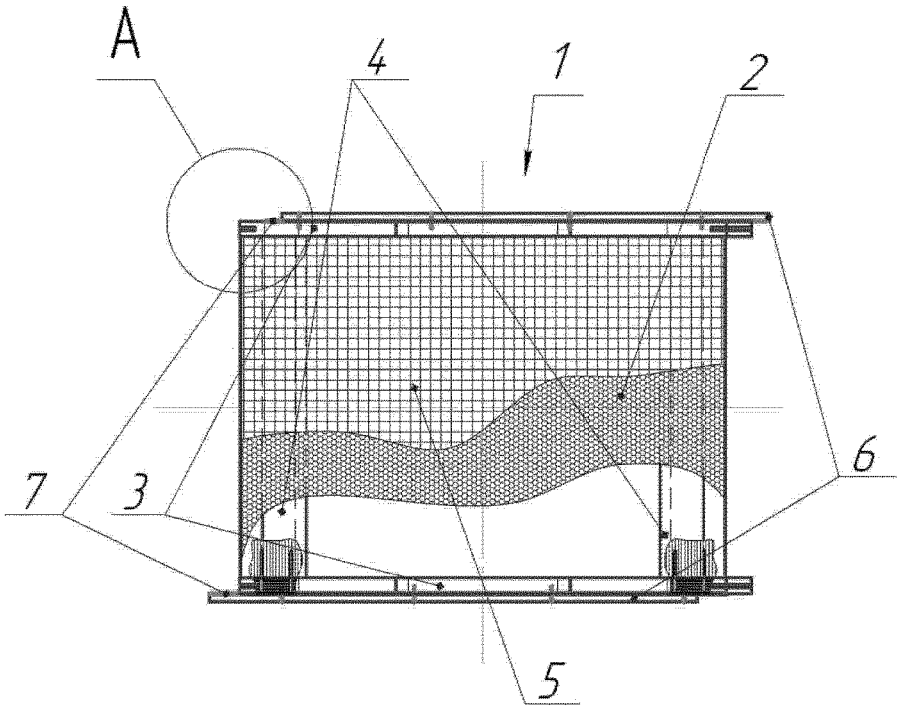

FIG. 3—the top view of the building element.

Figure 4:
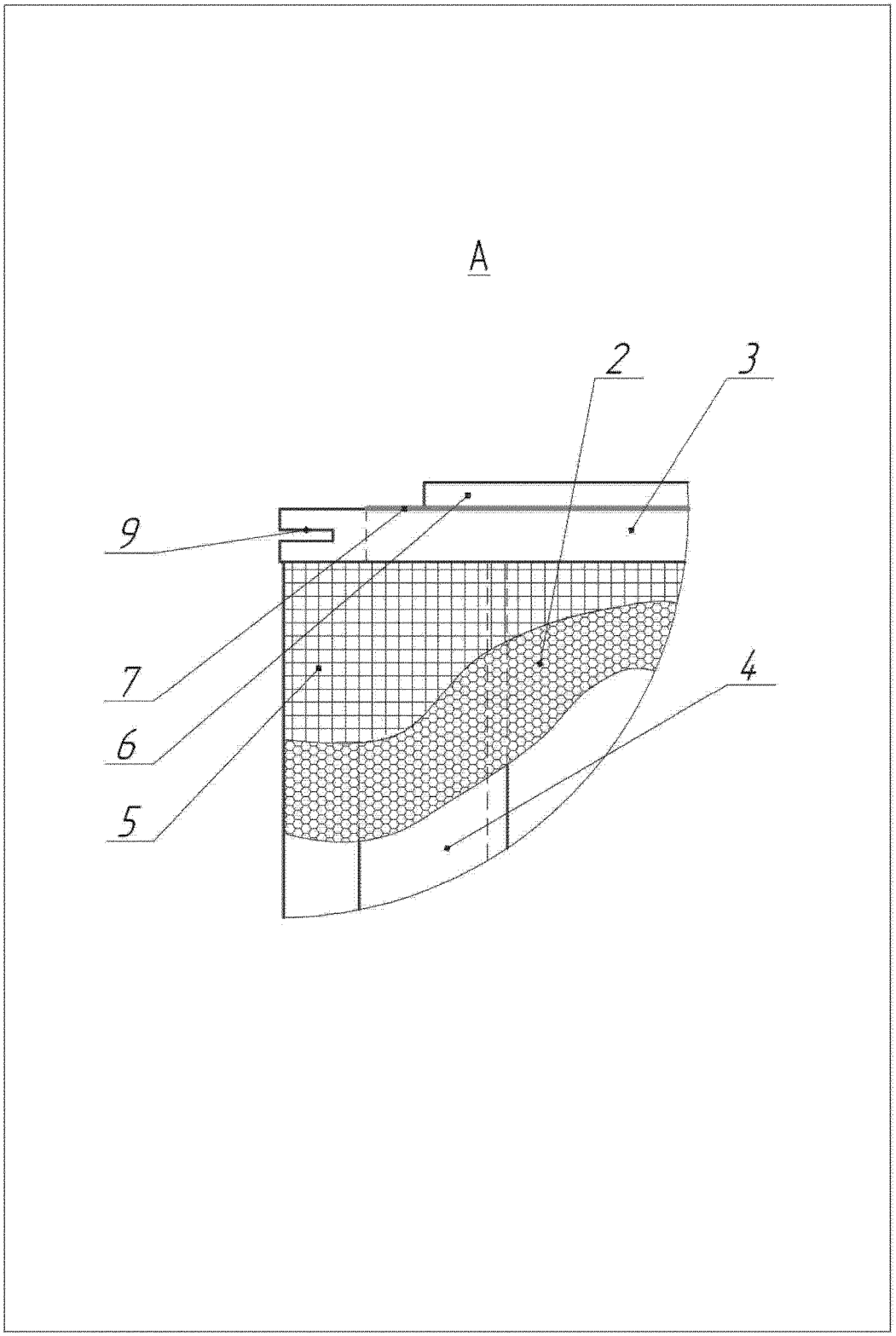

FIG. 4—the detail view of the part A of the FIG. 3.

Figure 5:
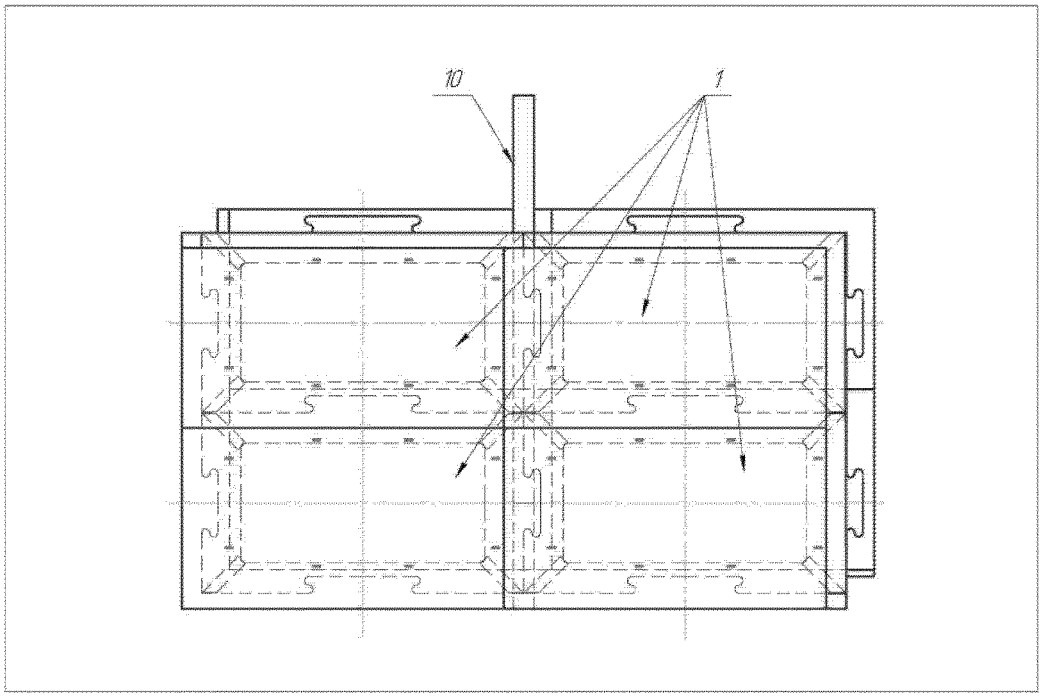

FIG. 5—a fragment of the front view of the building construction of 2 rows of building elements.

Building element 1 (FIGS. 1-3) consists of a block 2 made of a fibrous material that can be processed by a disinfecting solution or electromagnetic radiation. On the surfaces of the block 2 there are forming elements consisting of a pair of frames 3, their outer contour comprises curvilinear jigsaw-like locking elements and they are interconnected by transverse braces 4 making a single construction. The forming mesh 5 is disposed between the block 2 and frames 3 above the transverse braces 4. Outer and inner walls 6 are fastened on the outer walls of the frames 3. Membranes 7 are disposed between the walls 6 and frames 3 and extend beyond the edges of outer and inner walls 6.

On the ends of the vertical sides of the frames 3 there are slots for load-bearing fastening strips 10 (FIG. 4).

The frames 3 can be interconnected by, at least, one transverse brace 4 by fastening or interlock, or are made as a single construction by punching, molding or 3D printing.

The walls 6 can have distance spacers from the side of membranes 7 or can have double-layer walls with the distance spacers between them. (They are not presented on the drawings).

The building construction (FIG. 5) comprises building elements 1 which are joined to one another by the outer edges of the frames 3 by means of the curvilinear jigsaw-like locking elements and load-bearing fastening strips 10. The building elements 1 are arranged in a row and one above the other to form a single spatial construction.

The building elements 1 are produced in the following way. Dry fibrous material (of natural humidity), for example, of rye straw, wheat, oat, other herbs and cereals, husk of a sunflower, hemp sawdust is used to prepare a material for the block 2. It is disinfected by a disinfecting solution, gases, vapor, electromagnetic radiation, and, if necessary, ground mechanically to fractions needed for the applied technology. The block 2 can be produced in two ways: Under a certain pressure and with the additives of binder (bonding, gluing) substances (if necessary) there forms the block 2 of the needed shape with the density of 50-140 kg/m3. Or By blowing-in, suction, filling, screw pressing of the forming elements.

The load-bearing structure is formed from the building elements 1. The frames 3 are made of any sheet material that meets the conditions of bearing capacity and stability: Plywood (variants: Plastic, ceramics, concrete, glass, metal). The frames 3 have a complex configuration and they are produced with high precision (0.1-0.2 mm) on CNC-machines (variants: By punching, molding, 3D-printing). The outer contour comprises curvilinear jigsaw-like locking elements, on the ends of the vertical sides of these frames 3 there are slots for load-bearing fastening strips 10.

When producing the block 2 according to the first way, the sequence of assembling operations of the building element 1 is the following: transverse braces 4 are joined to one of the frames 3, and then are inserted in the molded block 2. On the other side of the block 2 transverse braces 4 are joined to another frame 3. The connection is done via fastening (clamps, nails, screws, glue, hooks, wire rod, latch and so on) or by custom-produced interlocks. Transverse braces 4 are made of the same materials as the frames 2 or their combinations. Transverse braces 4 and frames 3 form a single construction by punching, molding or 3D-printing. Transverse braces provide the element—a building block—with the needed durability and rigidity.

Then above the transverse braces and between the frames there's tightened a forming mesh 5 (plastic, metal, natural fibers). Above the frames 3 there are placed the membranes 7 and then the outer and inner walls 6 which are fastened by fastening (staples, screws, nails, latches, glue). They may be made of different materials, have different finish and color. Besides, in order to create outer and inner decor of the walls, both sides of the building elements may be made of different materials. The requirements of vapor and gas permeability of the walls 6 may be minimized, if there's an air gap of 30-50 mm between the membrane 7 and the wall 6. It can be done by using distance spacers pieces, or elsewise the walls 6 may have double layer walls with the distance spacers between (a variant of a ventilated facade).

If applying the second way of block production, the sequence of the assembling operations of the building element 1 is the following: When making a load-bearing structure of the element, the transverse braces 4 are joined to both of the frames 3. Then, as in the first method, above the transverse braces and between the frames there's tightened a forming mesh 5. Then above the frames 3 there are placed the membranes 7, and then the outer and inner walls 6 are placed and fastened.

After that in the cavity of the building element 1 between the frames 3 fastened by the transverse braces 4 and covered with a forming mesh 5 and fastened with membranes 7 and the walls 6 there's placed a prepared fibrous material (of a natural humidity) dry ground to the needed size fractions. Depending on the applied technology (blowing-in, suction, filling, screw pressing-in) the process of filling is done via a temporary technological cut in the forming mesh 5 or via a slot between the forming mesh 5 and the frames 3.

This method to produce the block 2 of the building element 1 is a preferable one in comparison with using pre-molded block 2, as it allows to reduce the density of the block 2 and, as a result, its heat conductivity. This increases the heat-insulating properties of the building construction with such blocks, reduces its weight, and the consumption of the fibrous materials. The density of the block 2 when produced in such a way can be reduced to 50-70 kg/m3 which represents an optimal value to stop convection processes of heat transfer inside the wall of the building construction. Given that this value of density will prevent the fibrous material from natural shrinkage due to its light weight in the building element small in height 1. The process of shrinkage of the fibrous material is prevented also by the forming meshes 5 which in this case act like membranes which divide the fibrous material into separate masses in which the gravitational shrinkage is evenly divided between the building construction. It prevents the appearance of void cavities and slots. The appearance of void cavities and slots is also prevented by the filling of the block 2 of the building element 1 with the fibrous material before the forming of the convex surface of the forming meshes 5. Later, during the assembly if the building construction the building elements inside the wall are joined by the formed convex surfaces—elastic "pads", which reduces air passages and improves the thermal characteristics of the construction.

Building Construction Assembly.

The building elements are arranged in a row and one above the other. Neighboring building elements are joined to one another by the outer edges of the frames 3 by means of the curvilinear jigsaw-like locking elements. The single spatial construction of the wall is formed without any fastening system with the help of load-bearing fastening strips 10 that are installed vertically in the slot 9 of the frames 3. The inner edge of the frames 3 forms a special large through hole that ensures diffusion of gases and vapors through the membranes 7 made of vapor- and gas permeability non-woven materials, woven materials, compressed natural sheet materials, etc. The outer and inner walls 6 have vapor- and gas permeability surfaces resistant to weather conditions, appropriate for internal use at home, meeting the environmental requirements, for example, fiber board made from wood chips with a low volume of cement (Green Board) In case the outer and inner walls 6 are formed as double ones with an air gap between them in the form of spacers, they can be made of materials with different useful properties, in terms of gas permeability and interior design, as well as durability, strength and exterior design.

Configurations and dimensions of the building elements according to the proposed technical solution can be standardized.

Size series of various configurations of the building elements according to the proposed technical solution will allow to accurately calculate necessary amount of required building elements and their types when designing different buildings and structures; that will eliminate building materials overconsumption.

The proposed building elements are mainly applied in building structures and buildings of different purposes and with different number of floors as a whole with appropriate architectural and design solutions.

The building element according to the invention makes it possible to construct rigid building structures of any complexity, configuration and height enough for personal low-rise building that is not a subject to shrinkage.

The application of the building elements according to the invention as a whole with appropriate architectural and design solutions, for example, along with strengthen connecting vertical elements specially formed or as building elements built in frame industrial structures made of iron and concrete, will remove any restrictions on the floors number.

REFERENCES

1. WO/2009/106793 A1,
2. U.S. Pat. No. 5,749,199.
3. Patent EA 021316.

The invention claimed is:

1. A building element comprising:

a block made of a fibrous material; and forming elements disposed on the surfaces of the block including:

a pair of frames interconnected by at least one transverse brace to form a single structure, a forming mesh disposed between the fibrous material block and the frames on top of the at least one transverse brace, outer and inner walls which are fastened from an outer side of the frames, and membranes disposed between the walls and the frames;

wherein an outer contour of the frames comprises curvilinear interlockable elements.

2. The building element according to claim 1 wherein each of the pair of frames has slots for load-bearing fastening strips on the ends of vertical sides of said frames.

3. The building element according to claim 1 wherein the membranes extend beyond the edge of the outer and inner walls.

4. The building element according to claim 1 wherein the block has been disinfected with a disinfecting solution or electromagnetic radiation.

5. The building element according to claim 1 wherein the pair of frames interconnected by at least one transverse brace is by means of a fastening system.

6. The building element according to claim 1 wherein the pair of frames interconnected by at least one transverse brace is by means of an interlock system.

7. The building element according to claim 1 wherein the pair of frames interconnected by at least one transverse brace is formed as a single structure by means of pressing, molding, or 3D printing.

8. The building element according to claim 1 wherein the outer and inner walls are spaced apart from the membrane with distance spacers.

9. The building element according to claim 1 wherein the outer and inner walls are formed as double walls which have distance spacers between them.

10. A building construction comprising a plurality of the building elements claimed in claim 1 in spatial construction, wherein the building elements are joined to one another by the outer edges of the frames by means of the curvilinear jigsaw-like locking elements and load-bearing fastening strips, and the building elements are arranged in a row and one above the other to form a single spatial construction.

* * * * *